US006575237B2

(12) United States Patent
Purkis et al.

(10) Patent No.: US 6,575,237 B2
(45) **Date of Patent: *Jun. 10, 2003**

(54) HYDRAULIC WELL CONTROL SYSTEM

(75) Inventors: Daniel G. Purkis, Cruden Bay (GB); Brett W. Bouldin, Spring, TX (US)

(73) Assignee: Welldynamics, Inc., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/782,742

(22) PCT Filed: Aug. 13, 1999

(86) PCT No.: PCT/GB99/02694

§ 371 (c)(1),
(2), (4) Date: Jun. 22, 2001

(87) PCT Pub. No.: WO00/09855

PCT Pub. Date: Feb. 24, 2000

(65) Prior Publication Data

US 2002/0007946 A1 Jan. 24, 2002

(51) Int. Cl.[7] ..... E21B 34/10
(52) U.S. Cl. ..... 166/72; 166/375; 166/319
(58) Field of Search ..... 166/50, 53, 72, 166/319, 363, 364, 375

(56) References Cited

U.S. PATENT DOCUMENTS

| | | | |
|---|---|---|---|
| 3,702,909 A | | 11/1972 | Kraakman |
| 3,906,726 A | | 9/1975 | Jameson |
| 3,970,144 A | | 7/1976 | Boykin, Jr. |
| 3,993,100 A | | 11/1976 | Pollard et al. |
| 4,036,106 A | | 7/1977 | Athy, Jr. |
| 4,197,879 A | | 4/1980 | Young |
| 4,234,043 A | | 11/1980 | Roberts |
| 4,296,910 A | | 10/1981 | Gratzmuller |
| 4,347,900 A | | 9/1982 | Barrington |
| 4,368,871 A | | 1/1983 | Young |
| 4,407,183 A | | 10/1983 | Milberger et al. |
| 4,442,902 A | | 4/1984 | Doremus et al. |
| 4,476,933 A | | 10/1984 | Brooks |
| 4,522,370 A | | 6/1985 | Noack et al. |
| 4,549,578 A | | 10/1985 | Hibbs et al. |
| 4,660,647 A | | 4/1987 | Richart |
| 4,796,699 A | | 1/1989 | Upchurch |
| 4,880,060 A | * | 11/1989 | Schwendemann et al. .. 166/319 |
| 4,942,926 A | | 7/1990 | Lessi |
| 4,945,995 A | | 8/1990 | Tholance et al. |
| 5,065,825 A | | 11/1991 | Bardin et al. |

(List continued on next page.)

FOREIGN PATENT DOCUMENTS

| | | |
|---|---|---|
| EP | 0344060 A | 11/1989 |
| GB | 2335216 A | 8/1999 |
| WO | WO 97/47852 A | 12/1997 |
| WO | WO 98/39547 A | 9/1998 |
| WO | WO 99/47788 A | 9/1999 |
| WO | WO 00/09855 A | 2/2000 |

*Primary Examiner*—David Bagnell
*Assistant Examiner*—Daniel P. Stephenson
(74) *Attorney, Agent, or Firm*—Marlin R. Smith

(57) ABSTRACT

A system for transmitting hydraulic control signals and hydraulic power to downhole well tools while reducing the number of hydraulic lines installed in the wellbore. Hydraulic control signals can be furnished at relatively lower pressures, and the hydraulic pressure within the line can be selectively increased over a threshold level to provide hydraulic actuation power. The system can provide multiple control paths through a few number of hydraulic lines to provide flexibility and verification of well tool operation. Closed loop hydraulic operation monitors well tool operation, and a combination of pressurized hydraulic lines can provide an operating code for selective downhole well tool control. Four hydraulic lines can provide independent control and actuation of seven well tools, and additional combinations can be constructed.

23 Claims, 6 Drawing Sheets

U.S. PATENT DOCUMENTS 5,101,907 A * 4/1992 Schultz et al. ..... 166/319
5,127,477 A * 7/1992 Schultz ..... 166/324
5,176,164 A 1/1993 Boyle
5,522,465 A 6/1996 Deare
5,547,029 A 8/1996 Rubbo et al.
5,906,220 A 5/1999 Thompson
5,975,204 A 11/1999 Tubel et al.
6,179,052 B1 1/2001 Purkis et al.
6,247,536 B1 * 6/2001 Leismer et al. ..... 166/305.1

* cited by examiner

| A | B | C | ICV | |
|---|---|---|---|---|
| 0 | 0 | 1 | Open | 1 |
| 0 | 1 | 0 | Close | 1 |
| 0 | 1 | 1 | Open | 2 |
| 1 | 0 | 0 | Close | 2 |
| 1 | 0 | 1 | Open | 3 |
| 1 | 1 | 0 | Close | 3 |

*Fig. 4*

| A | B | C | D | ICV | |
|---|---|---|---|---|---|
| 0 | 0 | 0 | 1 | Open | 1 |
| 0 | 0 | 1 | 0 | Close | 1 |
| 0 | 0 | 1 | 1 | Open | 2 |
| 0 | 1 | 0 | 0 | Close | 2 |
| 0 | 1 | 0 | 1 | Open | 3 |
| 0 | 1 | 1 | 0 | Close | 3 |
| 0 | 1 | 1 | 1 | Open | 4 |
| 1 | 0 | 0 | 0 | Close | 4 |
| 1 | 0 | 0 | 1 | Open | 5 |
| 1 | 0 | 1 | 0 | Close | 5 |
| 1 | 0 | 1 | 1 | Open | 6 |
| 1 | 1 | 0 | 0 | Close | 6 |
| 1 | 1 | 0 | 1 | Open | 7 |
| 1 | 1 | 1 | 0 | Close | 7 |

*Fig. 6*

HYDRAULIC WELL CONTROL SYSTEM

CROSS-REFERENCE TO RELATED APPLICATIONS

The present application is a U.S. national stage filing of PCT application no. PCT/GB99/02694, filed Aug. 13, 1999, which is a filing under the Patent Cooperation Treaty of prior U.S. application Ser. No. 09/133,747, filed Aug. 13, 1998, now U.S. Pat. No. 6,179,052, and which is related to copending U.S. application Ser. No. 09/510,701, filed Feb. 22, 2000. The disclosures of the above applications are incorporated herein by this reference.

BACKGROUND OF THE INVENTION

The present invention relates to a system for controlling the production of hydrocarbons and other fluids from downhole wells. More particularly, the invention relates to a system for providing hydraulic control signals and power through the same hydraulic line, and for providing integrated control of multiple well tools with a minimal number of hydraulic lines.

Various tools and tool systems have been developed to control, select or regulate the production of hydrocarbon fluids and other fluids produced downhole from subterranean wells. Downhole well tools such as sliding sleeves, sliding side doors, interval control lines, safety valves, lubricator valves, and gas lift valves are representative examples of control tools positioned downhole in wells.

Sliding sleeves and similar devices can be placed in isolated sections of the wellbore to control fluid flow from such wellbore section. Multiple sliding sleeves and interval control valves (ICVs) can be placed in different isolated sections within production tubing to jointly control fluid flow within the particular production tubing section, and to commingle the various fluids within the common production tubing interior This production method is known as "comingling" or "coproduction". Reverse circulation of fluids through the production of tubing, known as "injection splitting", is performed by pumping a production chemical or other fluid downwardly into the production tubing and through different production tubing sections.

Wellbore tool actuators generally comprise short term or long term devices. Short term devices include one shot tools and tool having limited operating cycles. Long term devices can use hydraulically operated mechanical mechanisms performing over multiple cycles. Actuation signals are provided through is mechanical, direct pressure, pressure pulsing, electrical, electromagnetic, acoustic, and other mechanisms. The control mechanism may involve simple mechanics, fluid logic controls, timers, or electronics. Motive power to actuated the tools can be provided through springs, differential pressure, hydrostatic pressure, or locally generated power.

Long term devices provide virtually unlimited operating cycles and are designed for operation through the well producing life. One long term safety valve device provides fail safe operating capabilities which closes the tubing interior with spring powered force when the hydraulic line pressure is lost. Combination electrical and hydraulic powered systems have been developed for downhole use, and other systems include sensors which verify proper operation of tool components.

Interval control valve (ICV) activation is typically accomplished with mechanical techniques such as a shifting tool deployed from the well surface on a workstring or coiled tubing. This technique is expensive and inefficient because the surface controlled rigs may be unavailable, advance logistical planning is required, and hydrocarbon production is lost during operation of the shifting tool. Alternatively, electrical and hydraulic umbilical lines have been used to remotely control one or more ICVs without reentry to the wellbore.

Control for one downhole tool can be hydraulically accomplished by connecting a single hydraulic line to a tool such as an ICV or a lubricator valve, and by discharging hydraulic fluid from the line end into the wellbore. This technique has several limitations as the hydraulic fluid exits the wellbore because of differential pressures between the hydraulic line and the wellbore. Additionally, the setting depths are limited by the maximum pressure that a pressure relief valve can hold between the differential pressure between the control line pressure and the production tubing when the system is at rest. These limitations restrict single line hydraulics to low differential pressure applications such a lubricator valves and ESP sliding sleeves. Further, discharge of hydraulic fluid into the wellbore comprises an environmental discharge and risks backflow and particulate contamination into the hydraulic system. To avoid such contamination and corrosion problems, closed loop hydraulic systems are preferred over hydraulic fluid discharge valves downstream of the well tool actuator.

Certain techniques have proposed multiple tool operation through a single hydraulic line. U.S. Pat. No 4,660,647 to Richart (1987) disclosed a system for changing downhole flow paths by providing different plug assemblies suitable for insertion within a side pocket mandrel downhole in the wellbore. In U.S. Pat. No. 4,796,699 to Upchurch (1989), an electronic downhole controller received pulsed signals for further operation of multiple well tools. In U.S. Pat. No. 4,942,926 to Lessi (1990), hydraulic fluid pressure from a single line was directed by solenoid valves to control different operations. A return means in the form of a spring facilitated return of the components to the original position. A second hydraulic line was added to provide for dual operation of the same tool function by controlling hydraulic fluid flow in different directions. Similarly, U.S. Pat. No. 4,945,995 to Thulance et al. (1990) disclosed an electrically operated solenoid valve for selectively controlling operation of a hydraulic line for opening downhole wellbore valves.

Other downhole well tools use two hydraulic lines to control a single tool. In U.S. Pat. No. 3,906,726 to Jameson (1975), a manual control disable valve and a manual choke control valve control the flow of hydraulic fluid on either side of a piston head. In U.S. Pat. No. 4,197,879 to Young (1980), and in U.S. Pat. No. 4,368,871 to Young (1983), two hydraulic hoses controlled from a vessel were selectively pressurized to open and close a lubricator valve during well test operations. A separate control fluid was directed by each hydraulic hose so that one fluid pressure opened the valve and a different fluid pressure closed the valve. In U.S. Pat. No. 4,476,933 to Brooks (1984), a piston shoulder functioned as a double acting piston in a lubricator valve, and two separate control lines were connected to conduits and to conventional fittings to provide high or low pressures in chambers on opposite sides of the piston shoulder. In U.S. Pat. No. 4,522,370 to Noack et al. (1985), a combined lubricator and retainer valve was operable with first and second pressure fluids and pressure responsive members, and two control lines provided two hydraulic fluid pressures to the control valve. This technique is inefficient because two hydraulic lines are required for each downhole tool, which magnifies the problems associated with hydraulic lines run through packers and wellheads.

Instead of multiple hydraulic lines, other techniques have attempted to establish an operating sequence. In U.S. Pat. No. 5,065,825 to Bardin et al. (1991), a solenoid valve was operated in response to a predetermined sequence to move fluid from one position to another. A check valve permitted discharge of oil into a reservoir to replenish the reservoir oil pressure. Other systems use electronic controllers downhole in the wellbore to distribute, however the electronics are susceptible to temperature induced deterioration and other reliability problems.

Multiple hydraulic lines downhole in a wellbore can extend for thousands of feet into the wellbore. In large wellbores having different production zones and multiple tool requirements, large numbers of hydraulic lines are required. Each line significantly increases installation cost and the number of components potentially subject to failure. Accordingly, a need exists for an improved well control system capable of avoiding the limitations of prior art devices. The system should be reliable, should be adaptable to different tool configurations and combinations, and should be inexpensive to deploy.

SUMMARY OF THE INVENTION

The present invention provides an apparatus and system for transmitting pressurized fluid between a wellbore surface and a well tool located downhole in the wellbore. The apparatus comprises at least two hydraulic lines engaged with the well tool for conveying said fluid to the well tool, and means for pressurizing the fluid within the hydraulic lines. The hydraulic lines are capable of providing communication control signals to the well tool are further capable of providing fluid pressure to actuate the well tool. In different embodiments of the invention, at least three hydraulic lines are each engaged with each well tool for selectively conveying the fluid to each well tool, and hydraulic control means engaged between said hydraulic lines and each well tool for selectively controlling actuation of each well tool in response to pressure changes within selected hydraulic lines.

The invention also provides a system for controlling at least three well tools located downhole in a wellbore. The system comprises hydraulic pressure means for selectively pressurizing a fluid, at least two hydraulic lines engaged with the hydraulic pressure means and with each well tool for selectively conveying fluid pressure to each well tool, and hydraulic control means engaged between each hydraulic line and each well tool. Each hydraulic control means is operable in response to selective pressurization of one or lore hydraulic lines by said hydraulic pressure means, and operation of a well tool through the pressurization of one hydraulic line displaces fluid which is conveyed through another hydraulic line.

BRIEF DESCRIPTION OF THE DRAWINGS

FIG. 4 shows a representative control code for the apparatus shown in FIG. 3.

FIG. 6 illustrates a representative control code for the system shown in FIG. 5.

DESCRIPTION OF THE PREFERRED EMBODIMENTS

The invention provides hydraulic fluid control for downhole well tools by uniquely utilizing hydraulics with logic circuitry. Such logic circuitry is analogous to electrical and electronics systems, and depends on Boolean logic using "AND" and "OR" gates in the form of hydraulic switches. Using this unique concept, digital control capability, or "digital-hydraulics" can be adapted to the control of downhole well tools such as ICVs.

Figure 1:
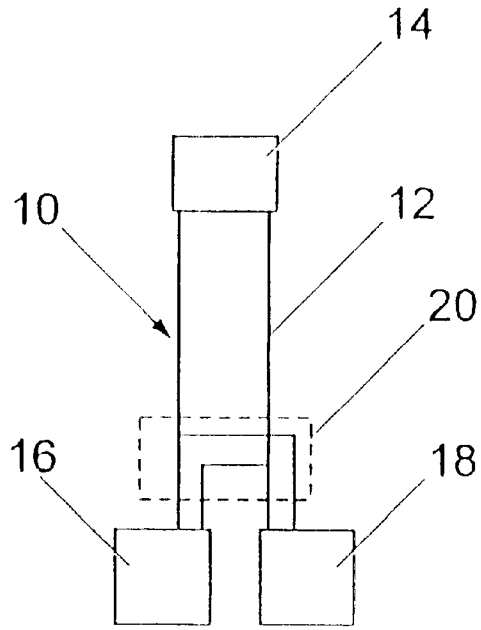
FIG. 1 illustrates a two hydraulic line system for providing hydraulic pressure control and power to well tools.

FIG. 1 illustrates two hydraulic lines 10 and 12 engaged with pump 14 for providing hydraulic pressure to fluid (not shown) in lines 10 and 12. Lines 10 and 12 are further engaged with downhole well tools 16 and 18 for providing hydraulic fluid pressure to tools 16 and 18. Pump 14 can comprise a controller for selectively controlling the fluid pressure within lines 10 and 12, and can cooperate with a hydraulic control means such as valve 20 located downhole in the wellbore in engagement with lines 10 and 12, and with tools 16 and 18. Selectively control over the distribution of hydraulic fluid pressure can be furnished and controlled with pump 14 at the wellbore surface, or with valve 20 downhole in the wellbore. Control signals to tools 16 and 18 and valve 20 can be provided within a different pressure range as that required for actuation of tools 16 and 18, and the ranges can be higher, lower, or overlapping.

Figure 2:
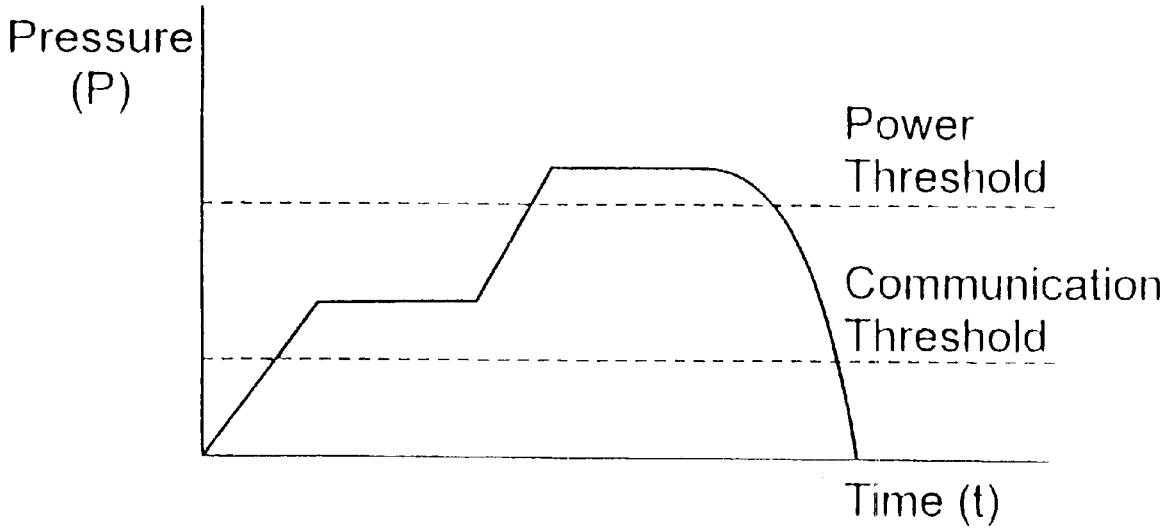
FIG. 2 illustrates a graph showing a hydraulic line pressure code for providing hydraulic control and power capabilities through the same hydraulic line.

FIG. 2 illustrates one combination of communication and power functions through the same hydraulic tubing, conduit, passage or line such as line 10 wherein the control signals are provided at lower pressures than the power actuation pressures. Pressure is plotted against time, and the hydraulic pressure is initially raised above the communication threshold but below the power threshold. Within this pressure range, communication signals and controls can be performed through the hydraulic line. The line pressure is raised to a selected level so that subsequent powering up of the hydraulic line pressure raises the line pressure to a certain level. Subsequent actuation of the well control devices, normally delayed as the pressure builds up within the long hydraulic tubing, occurs at a faster rate because the line is already pressurized to a certain level.

The invention further permits the use of additional hydraulic lines and combinations of hydraulic lines and controllers to provide a hydraulically actuated well control and power system. One embodiment of the invention is based on the concept that a selected number of hydraulic control lines could be engaged with a tool and that control line combinations can be used for different purposes. For example, a three control line system could use a first line for hydraulic power such as moving a hydraulic cylinder, a second line to provide a return path for returning fluid to the initial location, and all three lines for providing digital-hydraulic code capabilities. Such code can be represented by the following Table:

| Hydraulic Lines | | | | | |
|---|---|---|---|---|---|
| #1 | #2 | #3 | Digital Equation | Numeric Value Lines | |
| 0 | 0 | 0 | $0 \times 2^2 + 0 \times 2^1 + 0 \times 2^0$ | = | 0 |
| 0 | 0 | 1 | $0 \times 2^2 + 0 \times 2^1 + 1 \times 2^0$ | = | 1 |
| 0 | 1 | 0 | $0 \times 2^2 + 1 \times 2^1 + 0 \times 2^0$ | = | 2 |
| 0 | 1 | 1 | $0 \times 2^2 + 1 \times 2^1 + 1 \times 2^0$ | = | 3 |
| 1 | 0 | 0 | $1 \times 2^2 + 0 \times 2^1 + 0 \times 2^0$ | = | 4 |
| 1 | 0 | 1 | $1 \times 2^2 + 0 \times 2^1 + 1 \times 2^0$ | = | 5 |
| 1 | 1 | 0 | $1 \times 2^2 + 1 \times 2^1 + 0 \times 2^0$ | = | 6 |
| 1 | 1 | 1 | $1 \times 2^2 + 1 \times 2^1 + 1 \times 2^0$ | = | 7 |

If "1" represents a pressurized line and if "0" represents an unpressurized line, then the combination of hydraulic lines provides the described code format for a binary communication code. Because the hydraulic line operation can use both a pressurized and an unpressurized line in a preferred embodiment of the invention, codes 000 and 111 would not be used in this embodiment. However, if one or more lines discharged fluid to the outside of the line to the tubing exterior, another tool, or other location, codes 000 and 111 would be useful for transmitting power or signals. If codes 000 and 111 are excluded from use in the inventive embodiment described, the following six codes are available for tool control:

| #1 | #2 | #3 | | |
|---|---|---|---|---|
| 0 | 0 | 1 | — | 1 |
| 0 | 1 | 0 | — | 2 |
| 0 | 1 | 1 | — | 3 |
| 1 | 0 | 0 | — | 4 |
| 1 | 0 | 1 | — | 5 |
| 1 | 1 | 0 | — | 6 |

Figure 3:
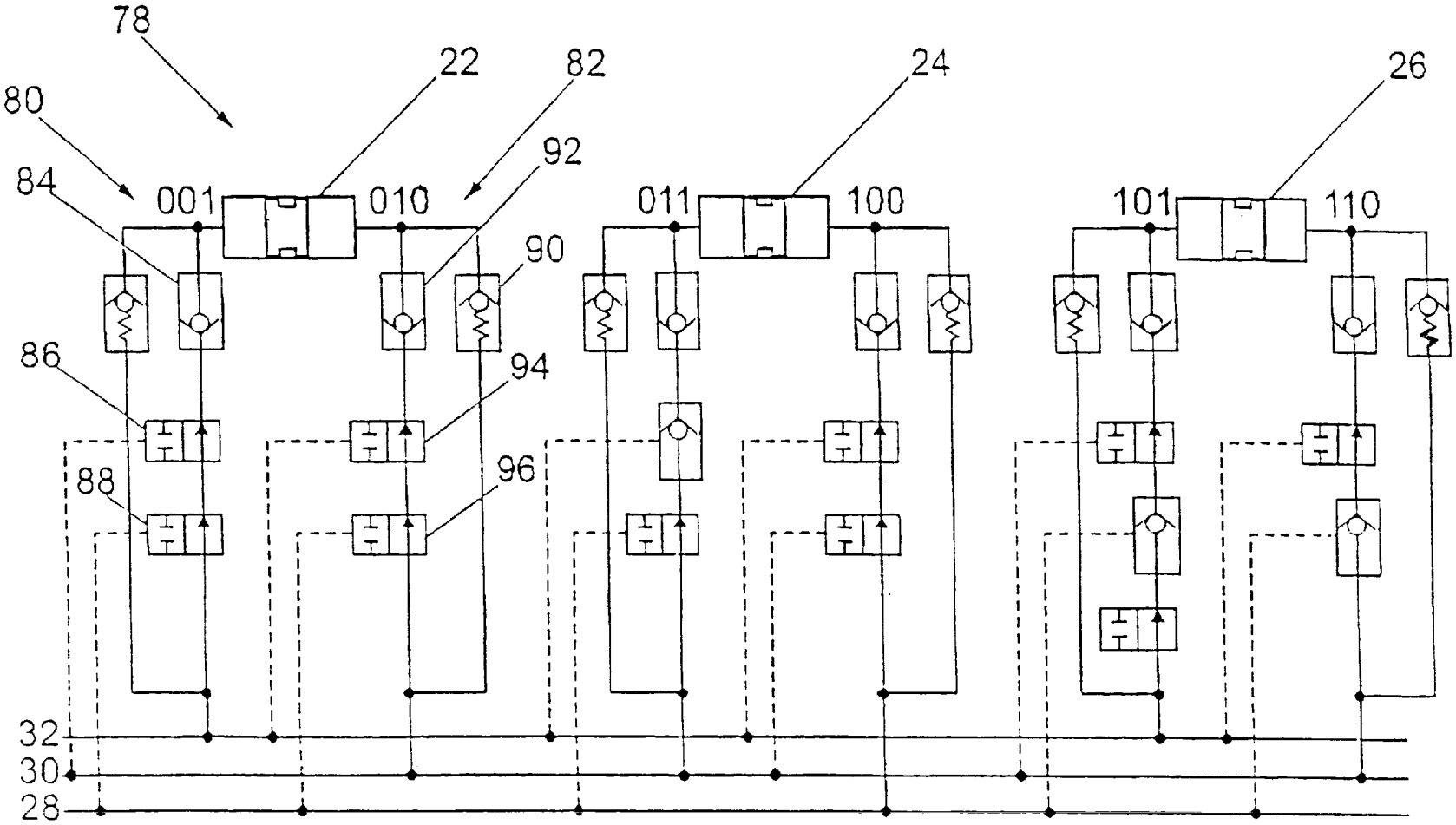
FIG. 3 illustrates a three well tool and three hydraulic line apparatus.

These codes are unique and can be grouped to provide six independent degrees of freedom to a hydraulic network. Different combinations are possible, and one combination permits the operation of three well tools such as ICVs 22, 24, and 26 leaving double actuated floating pistons as illustrated in FIG. 3. Lines 28, 30 and 32 are engaged between pump 14 and ICVs 22, 24, and 26. Lines 28, 30, and 32 could provide an opening code 001 for ICV 22. After a sufficient time lapse for all well tools such as the ICVs has occured to detect and register the 001 code, the line pressure can be raised above the power threshold until a selected pressure level is achieved. The pressure can be held constant at such level, or varied to accomplish other functions. The selected well tool such as ICV 22 is actuated, and return fluid is directed back through one or more of the lines designated as a "0", unpressurized line. Next, control line 32 is bled to zero and the entire system is at rest, leaving ICV 22 fully open until further operation. To open ICV 24, control linesw 28, 30, and 32 can be coded and operated as illustrated. After sufficient time has passed, the system pressure call be increased to operate ICV 24. The degrees of control freedom and operating controls can be represented by the following instructions:

| Hydraulic Line Number | | | |
|---|---|---|---|
| 28 | 30 | 32 | |
| 0 | 0 | 1 | Open ICV 22 |
| 0 | 1 | 0 | Close ICV 22 |
| 0 | 1 | 1 | Open ICV 24 |
| 1 | 0 | 0 | Close ICV 24 |
| 1 | 0 | 1 | Open ICV 26 |
| 1 | 1 | 0 | Close ICV 26 |

$$X = \frac{2^N - 2}{2}, \quad \text{and} \quad X = \frac{2^3 - 2}{2} = 3$$

control lines where

X equals the number of independently controlled ICVs, and

N equals the number of control lines.

Another combination is expressed below wherein additional ICVs 34 and 36 are added to build a five well tool system.

| Hydraulic Line Number | | | |
|---|---|---|---|
| 28 | 30 | 32 | |
| 0 | 0 | 1 | All ICVs Open |
| 0 | 1 | 0 | Close ICV 22 |
| 0 | 1 | 1 | Close ICV 24 |
| 1 | 0 | 0 | Close ICV 26 |
| 1 | 0 | 1 | Close ICV 34 |
| 1 | 1 | 0 | Close ICV 36 |

Z=2"−3, and Z=2'—3=5 control lines where

Z equals the number of dependently controlled ICVs, and

N equals the number of control lines.

The number of independently and dependently controlled ICVs provides system flexibility in the design of an operating system. For example,

| # of Control Lines N | #of Independent ICVs $X = \frac{2'' - 2}{2}$ | #of Dependent ICVs Z = 2" − 3 |
|---|---|---|
| 1 | 0 | 0 |
| 2 | 1 | 1 |
| 3 | 3 | 5 |
| 4 | 7 | 13 |
| 5 | 15 | 27 |
| 6 | 31 | 61 |
| 7 | 63 | 125 |
| 8 | 127 | 253 |

From this chart, the feasibility of the concept for one or two hydraulic lines does not offer significant control flexibility over single, dedicated hydraulic lines. At three control lines and greater, the benefits of the digital-hydraulic system become apparent as significant combinations of well control functions are available. For the majority of conventional downhole well uses, four control lines are adequate. However, the concepts taught by the invention provide additionally design flexibility to accommodate additional requirements as indicated.

A four ICV digital-hydraulic control system having seven independent devices and thirteen dependant devices can operate as follows:

| Hydraulic Line Number | | | | | |
|---|---|---|---|---|---|
| #1 | #2 | #3 | #4 | Independent | Dependent |
| 0 | 0 | 0 | 1 | Open ICV#1 | All ICVs open |
| 0 | 0 | 1 | 0 | Close ICV#1 | Close ICV#1 |
| 0 | 0 | 1 | 1 | Open ICV#2 | Close ICV#2 |
| 0 | 1 | 0 | 0 | Close ICV#2 | Close ICV#3 |
| 0 | 1 | 0 | 1 | Open ICV#3 | Close ICV#4 |
| 0 | 1 | 1 | 0 | Close ICV#3 | Close ICV#5 |
| 0 | 1 | 1 | 1 | Open ICV#4 | Close ICV#6 |
| 1 | 0 | 0 | 0 | Close ICV#4 | Close ICV#7 |
| 1 | 0 | 0 | 1 | Open ICV#5 | Close ICV#8 |
| 1 | 0 | 1 | 0 | Close ICV#5 | Close ICV#9 |
| 1 | 0 | 1 | 1 | Open ICV#6 | Close ICV#10 |
| 1 | 1 | 0 | 0 | Close ICV#6 | Close ICV#11 |
| 1 | 1 | 0 | 1 | Open ICV#7 | Close ICV#12 |
| 1 | 1 | 1 | 0 | Close ICV#7 | Close ICV#13 |

Figure 5:
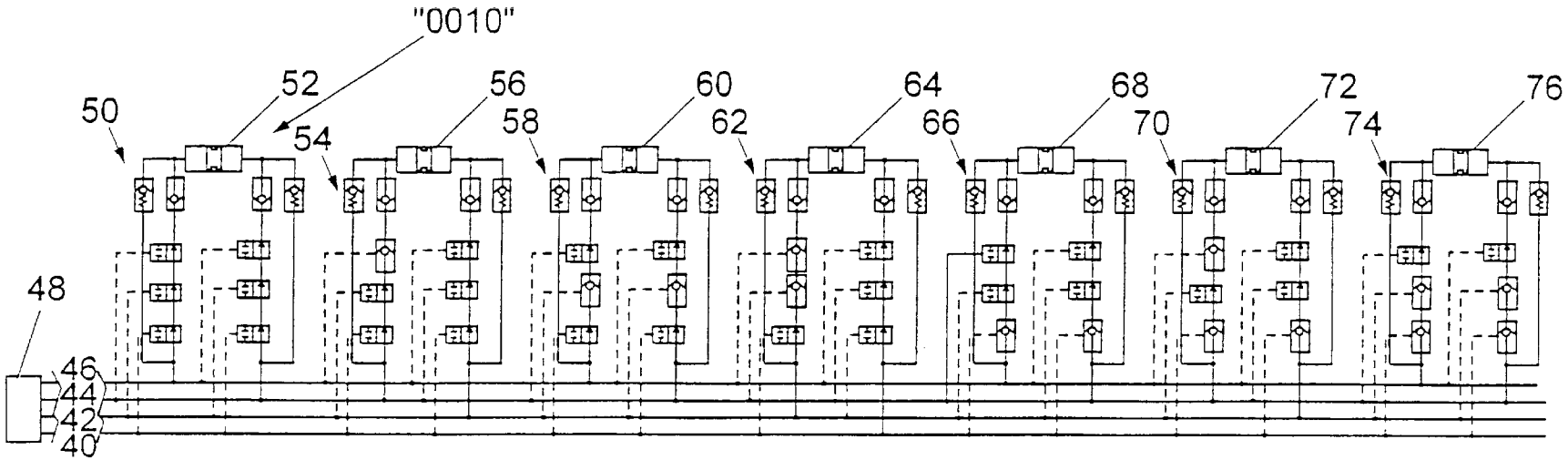
FIG. 5 illustrates a seven well tool and four hydraulic line system for providing selective well control and power.

A representative embodiment of a four hydraulic line system is illustrated in FIG. 5 wherein hydraulic lines 40, 42, 44 and 46 are engaged with controller 48, and are further engaged with hydraulic control means such as module 50 connected to tool 52, module 54 connected to tool 56, module 58 connected to tool 60, module 62 connected to tool 64, module 66 connected to tool 68, module 70 connected to tool 72, and module 74 connected to tool 76. Selective pressurization of lines 40, 42, 44 and 46 selectively operates one or more of such seven well tools according to a programmed code as represented in FIG. 6. For example, a code of "0010", wherein all lines are unpressurized except for the pressurization of line 44, operates to close tool 52 as illustrated.

Figure 7:
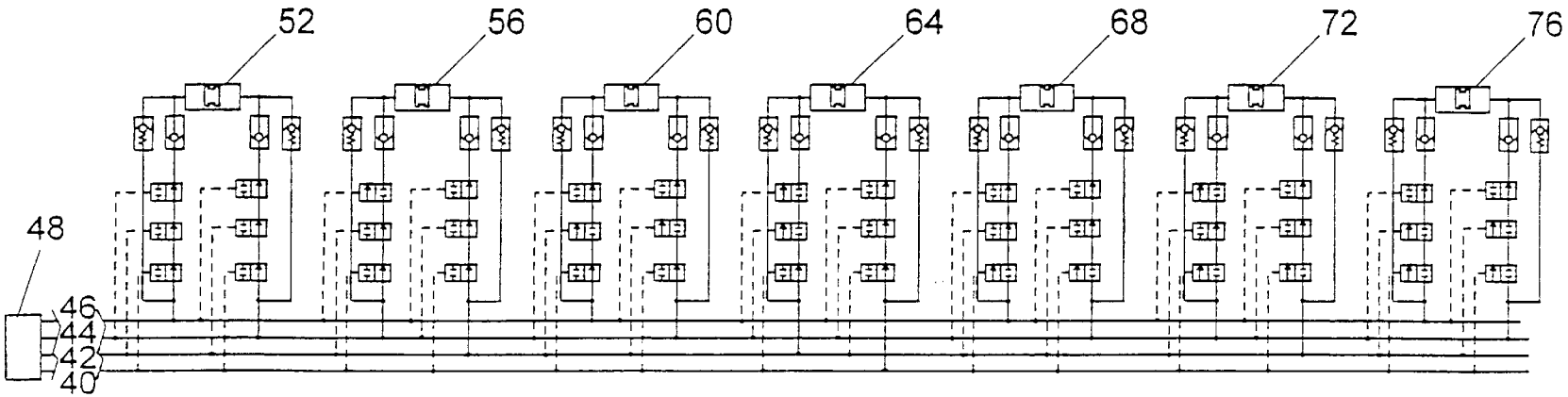
FIG. 7 illustrates another seven well tool and four hydraulic line system.

Each hydraulic control means or control mechanism can be designed with a combination of valves and other components to perform a desired function. Referring to FIG. 3, control mechanism 78 includes two control modules 80 and 82 each located on opposite sides of the floating piston within ICV 22. Control module 80 includes check valve engaged with line 32, and further includes check valve 84 engaged with pilot operated valves 86 and 88. Pilot operated valve 86 is engaged with line 30, and pilot operated valve 88 is engaged with line 28. Check valves 90 and 92 and pilot operated valves 94 and 96 are positioned as shown in FIG. 3 for control module 82. Similar combinations of modules and internal components are illustrated in FIG. 5 and in FIG. 7 for different operating characteristics.

The unique combination of valves and other components within each control module provides for unique, selected operating functions and characteristics. Depending on the proper sequence and configuration, pressurization of a hydraulic line can actuate one of the tools without actuating other tools in the system. Alternatively, various combinations of well tools could be actuated with the same hydraulic line if desired.

By providing communication and power capabilities, through the same hydraulic lines, the invention significantly eliminates problems associated with pressure transients. In deep wellbores, the hydraulic lines are very long and slender, which greatly affects the hydraulic line ability to quickly transmit pressure pulses or changes from the wellbore surface to a downhole tool location. In deep wellbores, five to ten minutes could be required before the hydraulic lines were accurately coded for the communication of sequenced controls. If some of the ICVs were located relatively shallow in the wellbore, such ICVs would receive the code long before other ICVs located deep in the wellbore. This configuration could cause confusion on the digital-hyraulics control circuit.

This problem can be resolved by dedicating certain lines for communication signals and other lines for power. Alternatively, a preferred embodiment of the invention utilizes such time delay characteristics by applying the communication coding early at relatively low pressures where the ICVs receive the codes but are not activated, and then the pressure is increased above a selected activation threshold to move the ICVs. This permits communication and power to be transmitted through the same hydraulic lines, and further uses the communication pressures to initially raise the line pressures to a selected level and to shorten the power up time required.

For another instruction, pistons within an ICV can be moved in a direction from the initial position toward a second position, and can be maintained above second position pressure. The device response initially directs the control line pressure to the second side of the piston actuator. As the piston responds to the force created by the differential pressure, fluid on the low pressure side is displaced into the tubing. The device eventually strokes fully and attains the second position, and the fluid will slowly bleed away.

Another embodiment of the invention is illustrated below where certain lines are dedicated as power lines and other lines are dedicated as communication control lines. A representative sequence code for a five Line tool system can be expressed as follows:

| Power Lines | | Communication Lines | | | | |
|---|---|---|---|---|---|---|
| #1 | #2 | A | B | C | Independent | Dependent |
| 0 | 1 | 0 | 0 | 0 | Open ICV#1 | All ICVs closed |
| 1 | 0 | 0 | 0 | 0 | Close ICV#1 | Open ICV#1 |
| 0 | 1 | 0 | 0 | 1 | Open ICV#2 | Open ICV#2 |
| 1 | 0 | 0 | 0 | 1 | Close ICV#2 | Open ICV#3 |
| 0 | 1 | 0 | 1 | 0 | Open ICV#3 | Open ICV#4 |
| 1 | 0 | 0 | 1 | 0 | Close ICV#3 | Open ICV#5 |
| 0 | 1 | 0 | 1 | 1 | Open ICV#4 | Open ICV#6 |
| 1 | 0 | 0 | 1 | 1 | Close ICV#4 | Open ICV#7 |
| 0 | 1 | 1 | 0 | 0 | Open ICV#5 | Open ICV#8 |
| 1 | 0 | 1 | 0 | 0 | Close ICV#5 | Open ICV#9 |
| 0 | 1 | 1 | 0 | 1 | Open ICV#6 | Open ICV#10 |
| 1 | 0 | 1 | 0 | 1 | Close ICV#6 | Open ICV#11 |
| 0 | 1 | 1 | 1 | 0 | Open ICV#7 | Open ICV#12 |
| 1 | 0 | 1 | 1 | 0 | Close ICV#7 | Open ICV#13 |
| 0 | 1 | 1 | 1 | 1 | Open ICV#8 | Open ICV#14 |
| 1 | 0 | 1 | 1 | 1 | Close ICV#8 | Open ICV#15 |
| | | | | | 5 Lines, 8 ICVs | 5 Lines, 15 ICVs |

Although more lines are required to control a certain number of well tools, this embodiment of the invention provides certain design benefits. Response time within the lines can be faster, a single pressure level can be utilized, and any possibility of confusion between a communication pressure code and a power pressure code is eliminated.

The invention is applicable to many different tools including downhole devices having more than one operating mode or position from a single dedicated hydraulic line. Such tools include tubing mounted ball valves, sliding sleeves, lubricator valves, and other devices. The invention is particularly suitable for devices having a two-way piston, open/close actuator for providing force in either direction in response to differential pressure across the piston.

The operating codes described above can be designed to provide a static operating code where the fluid pressures stabilize within each hydraulic line. By providing for static pressures at different levels, communication control signals can be provided by the presence or absence of fluid pressure, or by the fluid pressure level observed. For example, different pressure levels through one or more lines can generate different system combinations far in excess of the "0" and "1" combinations stated above, and can provide for multiple combinations at least three or four time greater. In effect, a higher order of combinations is possible by using different line pressures in combination with different hydraulic lines. Alternatively, the operation of a single line can be pulsed in cooperation with a well tool or a hydraulic control means operation, or can be pulsed in combination with two or more hydraulic lines to achieve additional control sequences. Such pulsing techniques further increase the number of system combinations available through a relatively few number of hydraulic lines, thereby providing maximum system capabilities with a minimum number of hydraulic lines.

Although the preferred embodiment of the invention permits hydraulic switching of the lines for operation of downhole well tools such as ICVs, switching functions could be performed with various switch techniques including electrical, electromechanical, acoustic, mechanical, and other forms of switches. The digital hydraulic logic described by the invention is applicable to different combinations of conventional and unconventional switches and tools, and provides the benefit of significantly increasing system reliability and of permitting a reduction in the number of hydraulic lines run downhole in the wellbore.

The invention permits operating forces in the range above 10,000 lb. and is capable of driving devices in different directions. Such high driving forces provide for reliable operation where environmental conditions causing scale and corrosion increase frictional forces over time. Such high driving forces also provide for lower pressure communication ranges suitable for providing various control operations and sequences.

The invention controls a large number of downhole well tools while minimizing the number of control lines extending between the tools and the wellbore surface. A subsurface safety barrier is provided to reduce the number of undesirable returns through the hydraulic lines, and high activation forces are provided in dual directions. The system is expandable to support additional high resolution devices, can support fail safe equipment, and can provide single command control or multiple control commands. The invention is operable with pressure or no pressure conditions, can operate as a closed loop or open loop system, and is adaptable to conventional control panel operations. A an open loop system, hydraulic fluid can be exhausted from one or more lines or well tools if return of the hydraulic fluid is not necessary to the wellbore application. The invention can further be run in parallel with other downhole wellbore power and control systems. Accordingly, the invention is particularly useful in wellbores having multiple zones or connected branch wellbores such as in multilateral wellbores.

Although the invention has been described in terms of certain preferred embodiments it will become apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. An apparatus for transmitting pressurized fluid between a wellbore surface and a well tool located downhole in the wellbore, comprising:

at least two hydraulic lines engaged with the well tool for conveying the fluid to the well tool, wherein the hydraulic lines are capable of providing communication control signals to the well tool, and wherein the hydraulic lines are further capable of providing fluid pressure to actuate the well tool, at least one of the hydraulic lines used to provide fluid pressure to actuate the well tool being the same as at least one of the hydraulic lines used to provide communication control signals to the well tool; and a fluid pressurizer coupled with the hydraulic lines to provide the communication signals and the fluid actuation pressure.

2. The apparatus as recited in claim 1, further comprising a controller for selectively pressurizing the hydraulic lines.

3. The apparatus as recited in claim 1 wherein the communication control signals are provided in a static code identified by the presence of a selected fluid pressure.

4. The apparatus as recited in claim 1, wherein the hydraulic lines are capable of providing well tool actuation pressure, after communication control signals are transmitted to the well tool, by increasing the fluid pressure in at least one hydraulic line.

5. The apparatus as recited in claim 1, wherein the hydraulic lines form a closed loop for returning fluid to the wellbore surface, further comprising means for detecting the return of fluid through one hydraulic line when another hydraulic line is pressurized.

6. An apparatus for transmitting pressurized fluid between a wellbore surface and a well tool located downhole in the wellbore, comprising:

at least two hydraulic lines engaged with the well tool for conveying the fluid to the well tool, wherein the hydraulic lines are capable of providing communication control signals to the well tool, and wherein the hydraulic lines are further capable of providing fluid pressure to actuate the well tool; and a fluid pressurizer coupled with the hydraulic lines to provide the communication signals and the fluid actuation pressure, the communication control signals comprising a lower pressure than the fluid pressure for actuating the well tool.

7. An apparatus for transmitting pressurized fluid between a wellbore surface and a well tool located downhole in the wellbore, comprising:

at least two hydraulic lines engaged with the well tool for conveying the fluid to the well tool, wherein the hydraulic lines are capable of providing communication control signals to the well tool, and wherein the hydraulic lines are further capable of providing fluid pressure to actuate the well tool; and a fluid pressurizer coupled with the hydraulic lines to provide the communication signals and the fluid actuation pressure, the communication control signals being provided in a pulsed sequence.

8. An apparatus for transmitting pressurized fluid between a wellbore surface and a well tool located downhole in the wellbore, comprising:

at least two hydraulic lines engaged with the well tool for conveying the fluid to the well tool, wherein the hydraulic lines are capable of providing communication control signals to the well tool, and wherein the hydraulic lines are further capable of providing fluid pressure to actuate the well tool; and a fluid pressurizer coupled with the hydraulic lines to provide the communication signals and the fluid actuation pressure, at least three well tools being each engaged with said two or more hydraulic lines, the apparatus further comprising a switch engaged with the hydraulic lines and the well tools for actuating one of the well tools by the selective pressurization of one hydraulic line.

9. An apparatus for transmitting pressurized fluid between a wellbore surface and a well tool located downhole in the wellbore, comprising:

at least two hydraulic lines engaged with the well tool for conveying the fluid to the well tool, wherein the hydraulic lines are capable of providing communication control signals to the well tool, and wherein the hydraulic lines are further capable of providing fluid pressure to actuate the well tool; and a fluid pressurizer coupled with the hydraulic lines to provide the communication signals and the fluid actuation pressure, at least three well tools being each engaged with the two or more hydraulic lines, the apparatus further comprising a switch engaged with the hydraulic lines and the well tools for actuating one of the well tools by the selective pressurization of two hydraulic lines.

10. An apparatus for transmitting pressurized fluid between a wellbore surface and a well tool located downhole in the wellbore, comprising:

at least two hydraulic lines engaged with the well tool for conveying the fluid to the well tool, wherein the hydraulic lines are capable of providing communication control signals to the well tool, and wherein the hydraulic lines are further capable of providing fluid pressure to actuate the well tool; and a fluid pressurizer coupled with the hydraulic lines to provide the communication signals and the fluid actuation pressure, one of the lines being dedicated to provide communication control signals.

11. An apparatus for transmitting pressurized fluid between a wellbore surface and a well tool located downhole in the wellbore, comprising:

at least two hydraulic lines engaged with the well tool for conveying the fluid to the well tool, wherein the hydraulic lines are capable of providing communication control signals to the well tool,,and wherein the hydraulic lines are further capable of providing fluid pressure to actuate the well tool; and a fluid pressurizer coupled with the hydraulic lines to provide the communication signals and the fluid actuation pressure, one of the lines being dedicated to provide fluid pressure to actuate the well tool.

12. An apparatus for transmitting pressurized fluid between a wellbore surface and three well tools located downhole in the wellbore, comprising:

at least three hydraulic lines each engaged with each well tool for selectively conveying the fluid to each well tool; and a controller engaged between the hydraulic lines and each well tool for selectively controlling actuation of each well tool in response to pressure changes within selected hydraulic lines.

13. The apparatus as recited in claim 12, wherein the controller comprises a hydraulic control means responsive to operation when contacted by changes in the pressure of the pressurized fluid.

14. The apparatus as recited in claim 12, wherein the well tools are actuatable in two directions from opposing positions of each well tool, and wherein the controller comprises two control modules separately engaged with the opposing well tool positions so that each control module is capable of providing selective fluid flow in two directions relative to the well tool.

15. The apparatus as recited in claim 14, wherein each control module comprises a hydraulic circuit having a check valve for resisting fluid flow from the tool direction and in communication with one of said hydraulic lines, and further comprises a pilot operated valve engaged with the hydraulic line and with the tool which is closed in an initial condition and is actuatable by a fluid pressure increase in one of the other hydraulic lines.

16. The apparatus as recited in claim 15, further comprising another pilot operated valve engaged with the hydraulic line and with the tool which is closed in an initial condition and is actuatable by a fluid pressure increase in the third of said hydraulic lines.

17. The apparatus as recited in claim 16, further comprising a check valve engaged in series with the pilot operated valve between the hydraulic line and the tool.

18. The apparatus as recited in claim 12, wherein the hydraulic lines are further capable of providing fluid pressure to actuate the well tool.

19. A system for controlling at least three well tools located downhole in a wellbore, comprising:

a hydraulic pressurizer located at the wellbore surface for selectively pressurizing a fluid;

at least two hydraulic lines engaged with the hydraulic pressurizer and with each well tool for selectively conveying fluid pressure to each well tool; and a hydraulic controller engaged between each hydraulic line and each well tool, wherein each hydraulic controller is operable in response to selective pressurization of one or more hydraulic lines by the hydraulic pressurizer, and wherein operation of a well tool through the pressurization of one hydraulic line displaces fluid which is conveyed through another hydraulic line, at least one of the hydraulic lines used to provide fluid pressure to actuate one of the at least three well tools being the same as at least one of the hydraulic lines used to operate the hydraulic controller associated with the one of the at least three well tools.

20. The system as recited in claim 19, further comprising a fluid, controller for detecting the displaced fluid conveyed through a hydraulic line during operation of a well tool.

21. A system for controlling at least three well tools located downhole in a wellbore, comprising:

a hydraulic pressurizer for selectively pressurizing a fluid;

at least two hydraulic lines engaged with the hydraulic pressurizer and with each well tool for selectively conveying fluid pressure to each well tool;

a hydraulic controller engaged between each hydraulic line and each well tool, wherein each hydraulic controller is operable in response to selective pressurization of one or more hydraulic lines by the hydraulic pressurizer, and wherein operation of a well tool through the pressurization of one hydraulic line displaces fluid which is conveyed through another hydraulic line; and a fluid controller for detecting the displaced fluid conveyed through a hydraulic line during operation of a well tool, wherein the fluid controller is capable of measuring the displaced fluid conveyed through the hydraulic line.

22. A system for controlling at least three well tools located downhole in a wellbore, comprising:

a hydraulic pressurizer for selectively pressurizing a fluid;

at least two hydraulic lines engaged with the hydraulic pressurizer and with each well tool for selectively conveying fluid pressure to each well tool; and a hydraulic controller engaged between each hydraulic line and each well tool, wherein each hydraulic controller is operable in response to selective pressurization of one or more hydraulic lines by the hydraulic pressurizer, and wherein operation of a well tool through the pressurization of one hydraulic line displaces fluid which is conveyed through another hydraulic line, wherein the number of hydraulic lines engaged with the hydraulic pressurizer and with each well tool is equal to the number of well tools located downhole in the wellbore.

23. A system for controlling at least three well tools located downhole in a wellbore, comprising:

a hydraulic pressurizer for selectively pressurizing a fluid, wherein the hydraulic pressurizer is capable of reducing hydraulic pressure for the pressurized fluid below a selected pressure;

at least two hydraulic lines engaged with the hydraulic pressurizer and with each well tool for selectively conveying fluid pressure to each well tool; and a hydraulic controller engaged between each hydraulic line and each well tool, wherein each hydraulic controller is operable in response to selective pressurization of one or more hydraulic lines by the hydraulic pressurizer, wherein operation of a well tool through the pressurization of one hydraulic line displaces fluid which is conveyed through another hydraulic line, and wherein each hydraulic controller is capable of preventing further movement of the corresponding tool following pressure reduction by the hydraulic pressurizer of the pressurized fluid, at least one of the hydraulic lines used to provide fluid pressure to actuate one of the at least three well tools is the same as at least one of the hydraulic lines used to operate the hydraulic controller associated with the one of the at least three well tools.

* * * * *